US010718173B2

(12) United States Patent
Pray

(10) Patent No.: US 10,718,173 B2
(45) Date of Patent: Jul. 21, 2020

(54) SELF-ADJUSTING SLIPS

(71) Applicant: Weatherford Technology Holdings, LLC, Houston, TX (US)

(72) Inventor: Jeffery Scott Pray, Shenandoah, TX (US)

(73) Assignee: WEATHERFORD TECHNOLOGY HOLDINGS, LLC, Houston, TX (US)

( * ) Notice: Subject to any disclaimer, the term of this patent is extended or adjusted under 35 U.S.C. 154(b) by 316 days.

(21) Appl. No.: 15/445,558

(22) Filed: Feb. 28, 2017

(65) Prior Publication Data

US 2018/0245414 A1 Aug. 30, 2018

(51) Int. Cl.
*E21B 23/01* (2006.01)
*E21B 29/06* (2006.01)

(52) U.S. Cl.
CPC ..... *E21B 23/01* (2013.01); *E21B 29/06* (2013.01)

(58) Field of Classification Search
CPC ..... E21B 23/01; E21B 29/06
See application file for complete search history.

(56) References Cited

U.S. PATENT DOCUMENTS

| | | | | |
|---|---|---|---|---|
| 6,073,693 | A | 6/2000 | Aldridge | |
| 6,189,610 | B1 | 2/2001 | LaClare et al. | |
| 6,318,459 | B1 | 11/2001 | Wright et al. | |
| 9,366,097 | B2 | 6/2016 | Hu et al. | |
| 9,453,377 | B2 | 9/2016 | Mosing et al. | |
| 2004/0112590 | A1* | 6/2004 | LaClare | E21B 23/01 166/217 |
| 2005/0139361 | A1* | 6/2005 | Aldridge | E21B 23/01 166/382 |
| 2006/0207771 | A1 | 9/2006 | Rios et al. | |
| 2009/0126926 | A1 | 5/2009 | Moore | |

OTHER PUBLICATIONS

PCT International Search Report and Written Opinion dated May 3, 2018, for International Application No. PCT/US2018/018202.

* cited by examiner

*Primary Examiner* — Brad Harcourt
(74) *Attorney, Agent, or Firm* — Patterson + Sheridan, LLP

(57) ABSTRACT

A method and apparatus for an anchor for use downhole. In one embodiment, the anchor includes an upper portion and a lower portion. In a run-in position, the anchor has a smaller outer diameter and in a set position, the anchor has a larger outer diameter. A slip assembly includes at least one slip, the slip having a longitudinal axis parallel to the longitudinal axis of the anchor and rotatable relative to the anchor along its longitudinal axis.

23 Claims, 8 Drawing Sheets

SELF-ADJUSTING SLIPS

BACKGROUND OF THE INVENTION

Field of the Invention

Embodiments of the present invention generally relate to self-adjusting slips. More particularly, the invention relates to an anchor assembly having slips that are self-adjusting based upon an inner diameter of a surrounding tubular. More particularly still, the invention relates to an anchor assembly for a whipstock used to facilitate the formation of a lateral wellbore, the assembly having self-adjusting slips.

Description of the Related Art

In the recovery of hydrocarbons, including oil and gas, wellbores are drilled into the earth in a manner intended to intersect hydrocarbon-bearing formations. To facilitate recovery and to prevent unwanted migration of material, the wellbores are typically lined with steel tubular (casing) which is cemented in place. From time to time, additional wellbores are needed to access adjacent formations and it is increasingly common for those new wellbores to be formed or "side tracked" from existing wellbores. In these instances, a whipstock having a concave, ramped surface is anchored in the wellbore at a predetermined location and then a bit or mill issued to form a window in the casing. Once the window is formed, the new wellbore is drilled resulting in two wellbores that share a common path to the surface. Successful use of a whipstock depends on the success of the anchoring operation that holds the whipstock in place during the formation of the window and thereafter as tools and work strings are run in and out of the new wellbore. Anchoring requires extendable slips to be placed in contact with the wall of casing. Because the inner diameter of casing can vary and be uneven, there is a need for an anchoring mechanism that can compensate for variations in the inner surface of a tubular string.

SUMMARY OF THE INVENTION

The present invention generally relates to self adjusting slips for use on an anchor in a wellbore.

BRIEF DESCRIPTION OF THE DRAWINGS

So that the manner in which the above recited features of the present invention can be understood in detail, a more particular description of the invention, briefly summarized above, may be had by reference to embodiments, some of which are illustrated in the appended drawings. It is to be noted, however, that the appended drawings illustrate only typical embodiments of this invention and are therefore not to be considered limiting of its scope, for the invention may admit to other equally effective embodiments.

DETAILED DESCRIPTION

The present invention relates to an adjustable slip for a downhole anchor.

Figure 1:
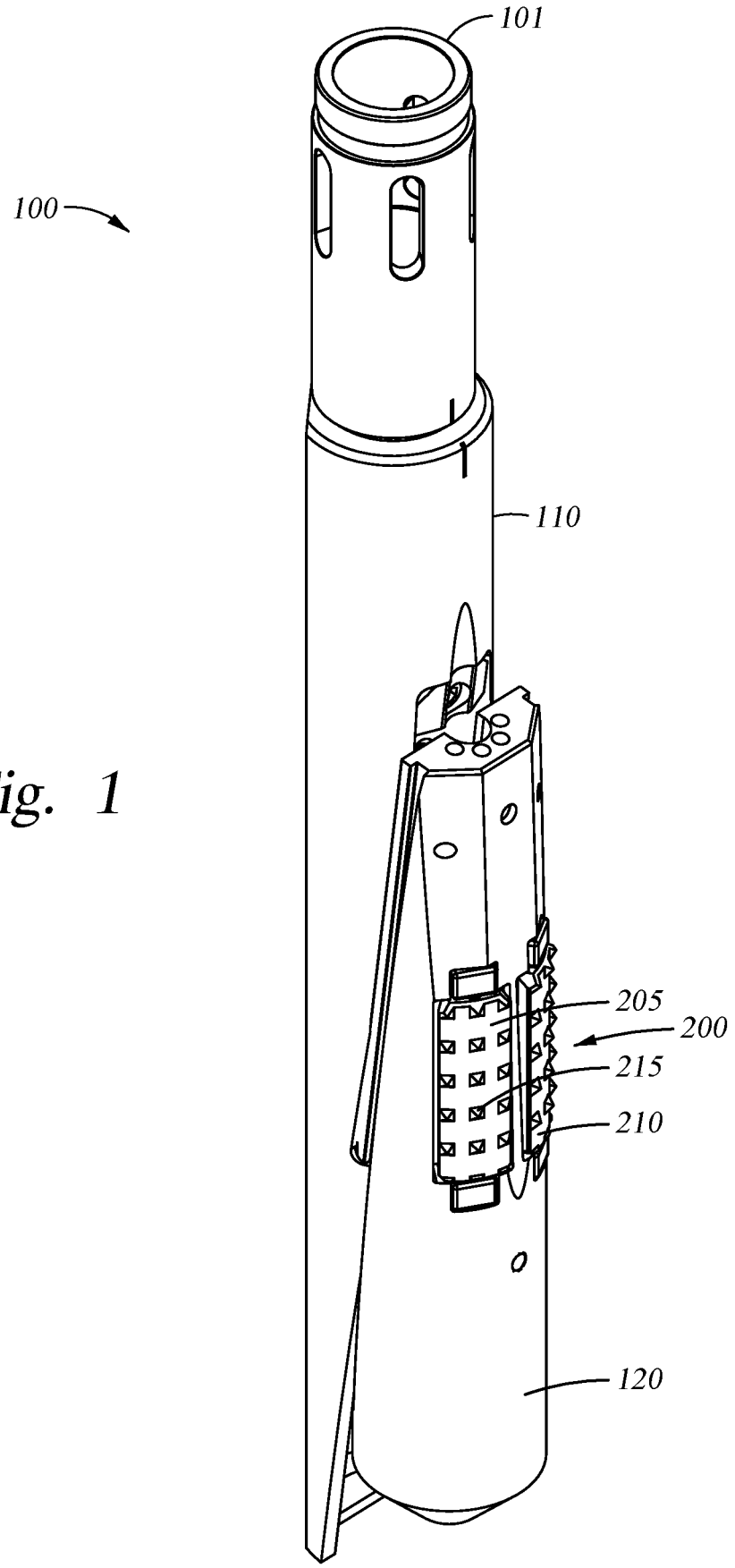
FIG. 1 is a perspective view showing an anchor assembly having aspects of the invention.

FIG. 1 is a perspective view showing an anchor assembly 100 having aspects of the invention. The assembly comprises an upper portion 110 and a lower portion 120, the lower potion including a slip assembly 200. In the embodiment shown, the slip assembly includes a first 205 and second 210 slips, each having a number of wickers 215 to assist in holding the set assembly 100 in place in the interior of a tubular (not shown). The anchor assembly includes a connection means 101 for connection to another tool, like a whipstock (not shown) at its upper end. typically, the assembly 100 is used at a lower end of a whipstock and once the whipstock is at a predetermined depth and orientation in a wellbore, the assembly is used to anchor the whipstock in place where a concave ramped surface of the whipstock then permits a sidetracked wellbore to be formed. In one embodiment, a work string is run into a well with the following components (from bottom up): an anchoring assembly 100, a whipstock, and a mill or drill connected with a shearable member to the whipstock. Once the assembly is set in the wellbore, the shearable member is sheared and the work string rotates and advances the mill/drill along the concave ramped surface of the whipstock to form a window in the casing wall.

Figure 2:
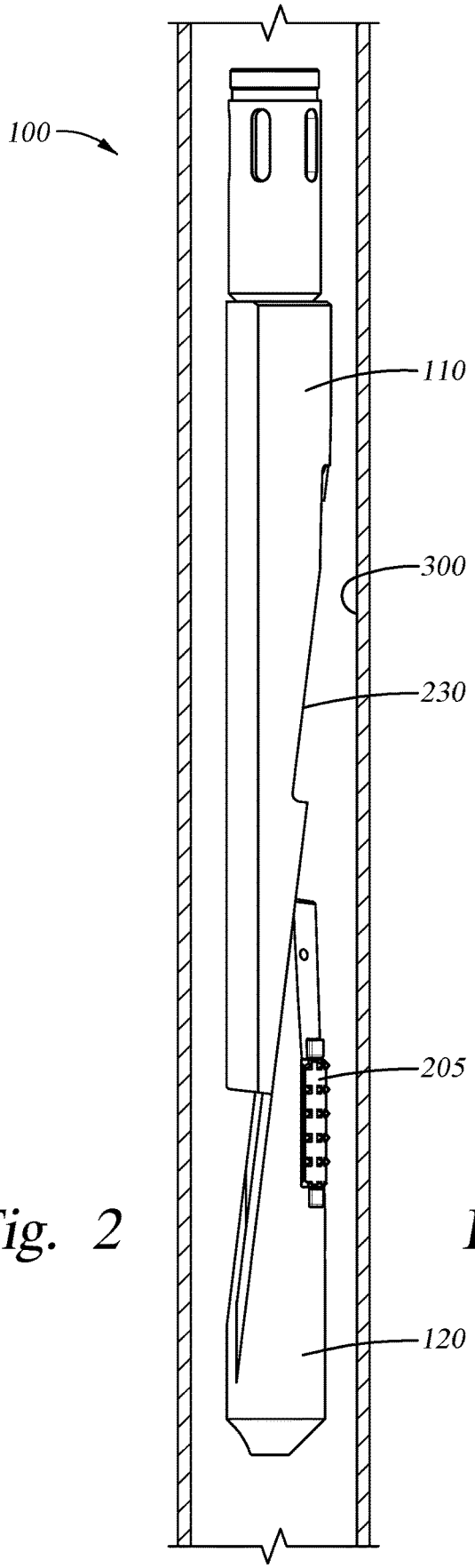
FIG. 2 is a side view of the anchor assembly in an unset position relative to a tubular therearound.
Figure 3:
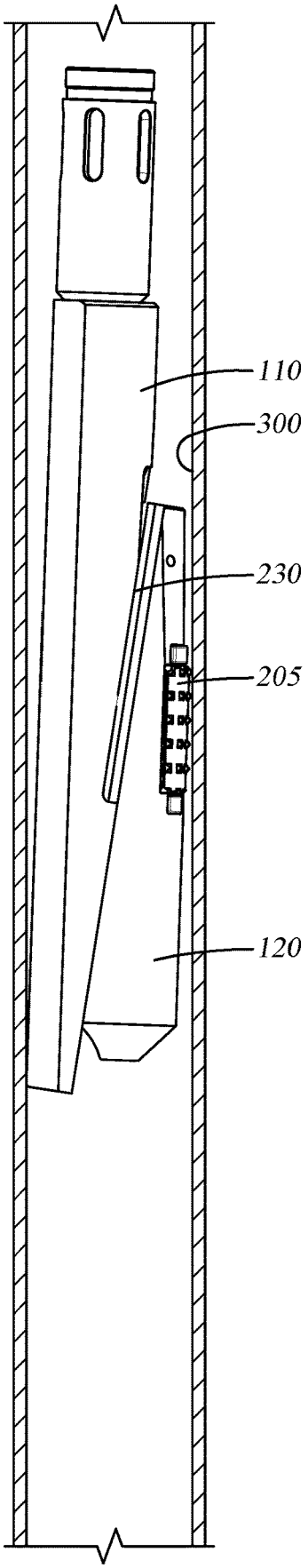
FIG. 3 is a side view of the anchor assembly in a set position relative to the tubular.

FIGS. 2 and 3 illustrate the anchoring assembly 100 in unset and set positions, respectfully. To set the assembly, the lower portion 120 is raised relative to the upper portion 110 either by fluid pressure or mechanical movement. In one example, the two portions 110, 120 are held in an unset position (FIG. 2) by a shearable member against an upward force of a biasing member, like a spring (not shown). Once the assembly is ready to be set, the shearable member is sheared by fluid force and the spring causes the lower portion 120 to move upwards along a ramp-shaped portion 230 of the upper portion, thereby enlarging the outer diameter of the assembly 100 and placing the slips 205, 210 in contact with the casing wall 300 on a first side. On an opposite side, the body of the upper portion 110 of the assembly 100 is in contact with an opposite wall of the casing 300. Additional downward pressure on the upper portion 110 from above further anchors the assembly 100 in the wellbore as the upper portion is urged downwards along the surface of the casing wall. FIG. 3 shows the assembly 100 wedged within the inner diameter of the casing 300.

Figure 4:
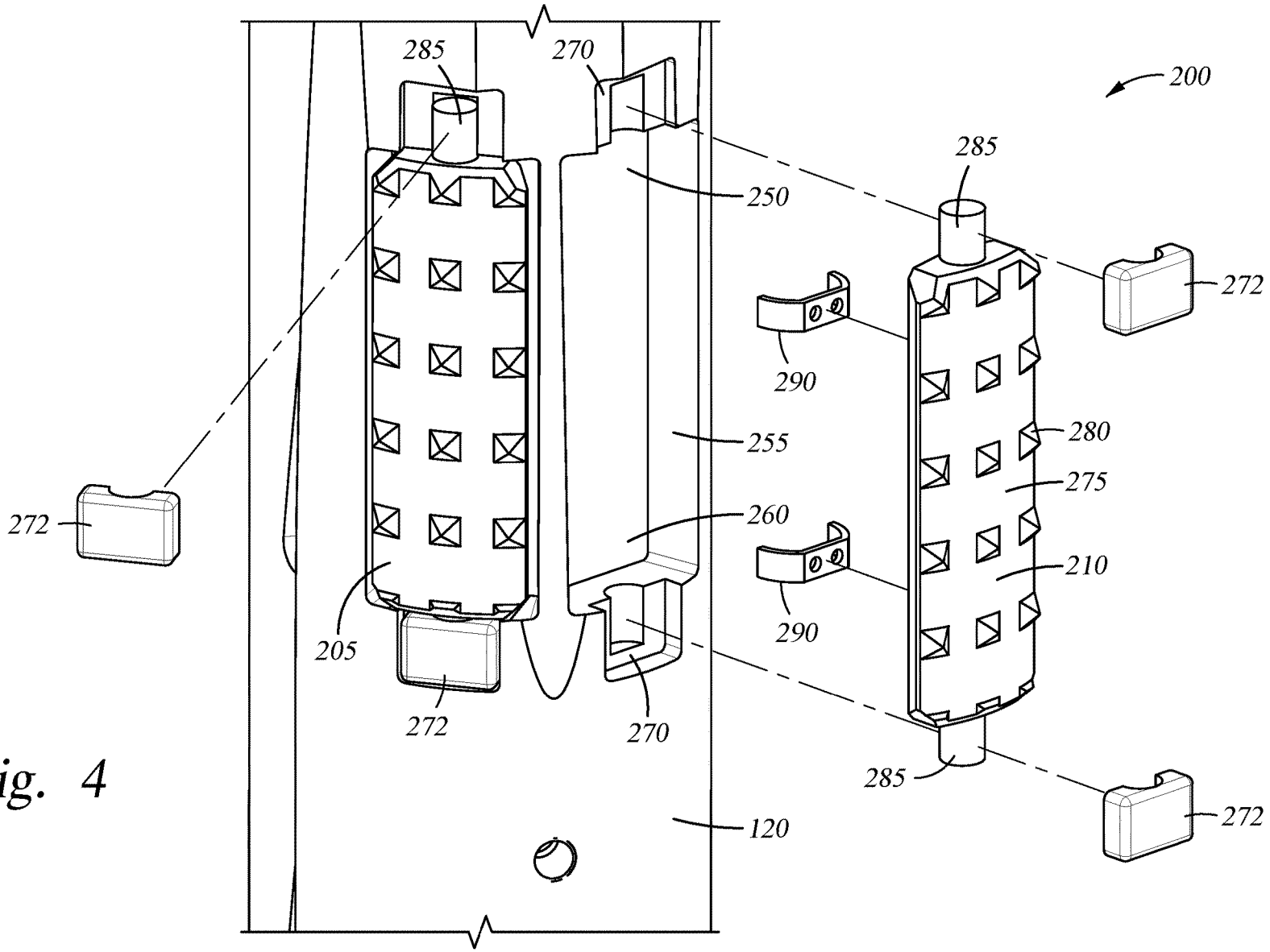
FIG. 4 is a partially exploded view showing a slip assembly associated with the anchor assembly.
Figure 5:
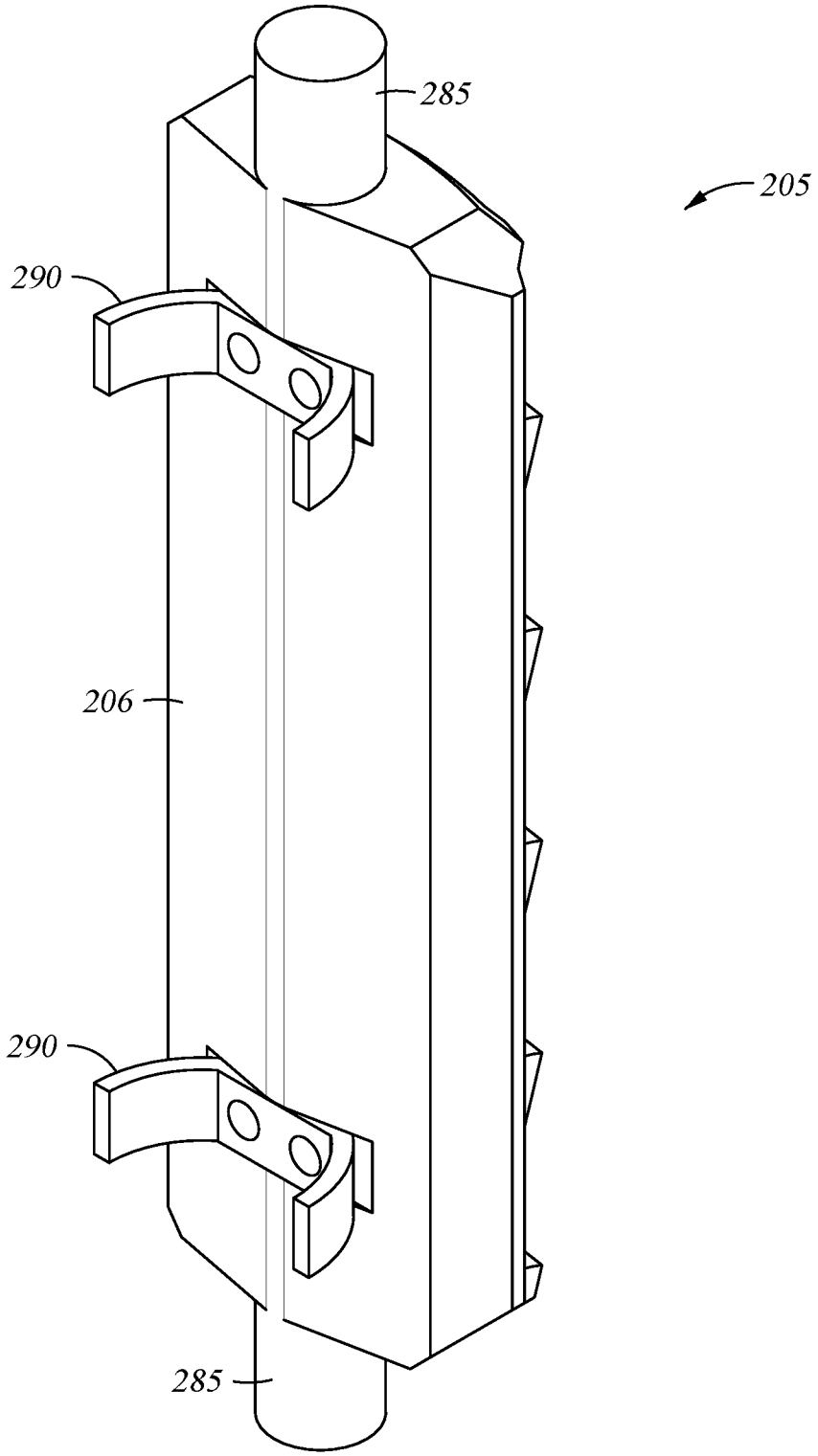
FIG. 5 is a perspective view of an underside of a slip of FIG. 4.

FIG. 4 is a partially exploded view showing first 205 and second 210 slips associated with the slip assembly 200. As shown in FIGS. 1-3, the slip assembly is located in the lower portion 120 of the anchor assembly 100. Returning to FIG. 4, each slip 205, 210 is installed in a pocket 250 having walls 255 and a floor 260. At each end of the pocket is a bearing housing 270. Each slip includes a body 275 with a plurality of wickers 280 formed on an outer surface thereof. In the embodiment show, the wickers are arranged in rows and columns. At each end of the slip body 275 is a bearing 285 that is seated in the bearing housing 270. A bearing cover 272 is installed at each end and serves to fix the slip 205, 210 in its respective pocket 250. Each slip is constructed and arranged to rotate about its longitudinal axis and when installed in the pocket 250, a gap G is formed between a lower surface 206 of the slip and the floor 260 of the pocket to permit rotation (see FIG. 6A). As shown in FIGS. 4, 5, 6A-7B, the underside of each slip 210, 215 is equipped with metallic centering members 290 to keep the slip rotationally centered in the pocket 250 during run-in of the anchoring assembly 100. Each centering member 290 includes two resilient legs 292 and in the centered position, each leg contacts the floor 260 of its respective pocket 260.

Figure 6A:
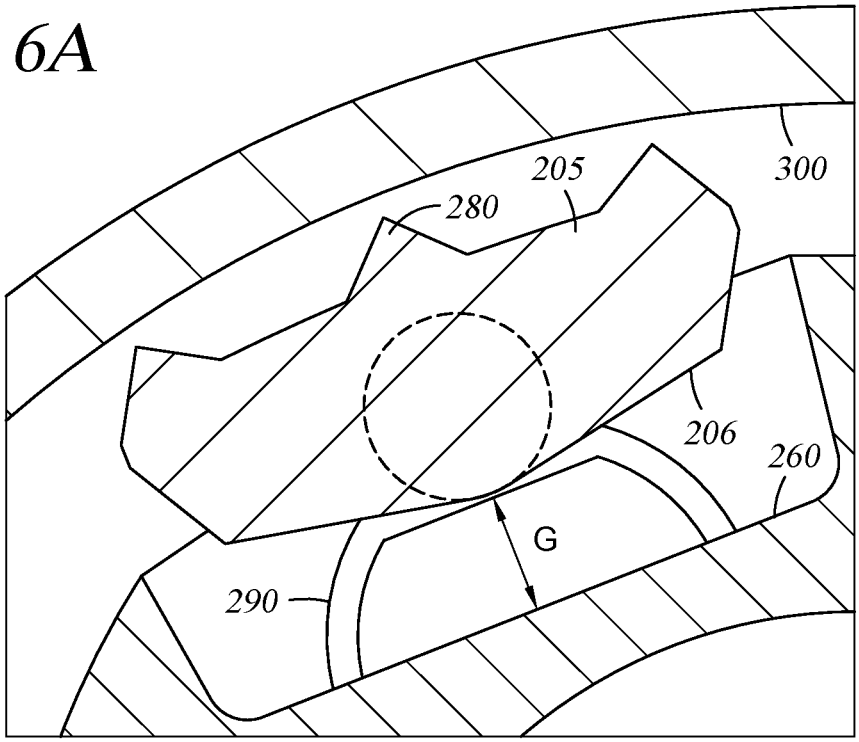
FIGS. 6A and 6B illustrate a slip before and after setting against a tubular wall, the wall having a relatively large ID.
Figure 6B:
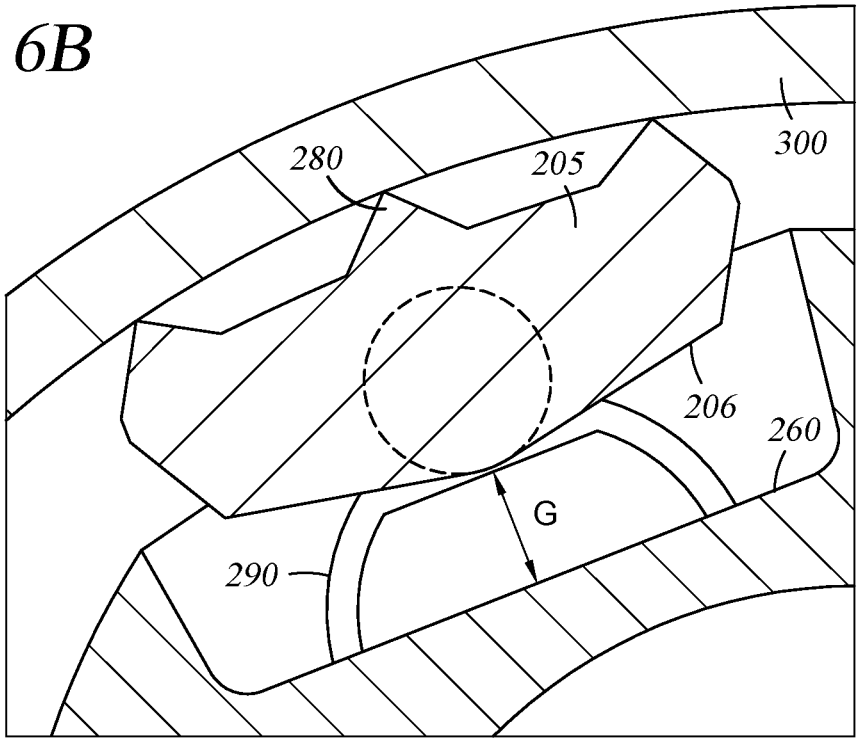

FIGS. 6A and 6B illustrate a slip 205 (or 210) before and after setting against a tubular wall 300 having a relatively large ID. As shown in the Figures, due to the size of the casing ID, the slip 210 remains in or near its rotationally centered orientation even after its wickers 280 are set against the casing wall 300. This is true even though the slip is off-set from the centerline of the anchoring tool (see FIG. 1).

Figure 7A:
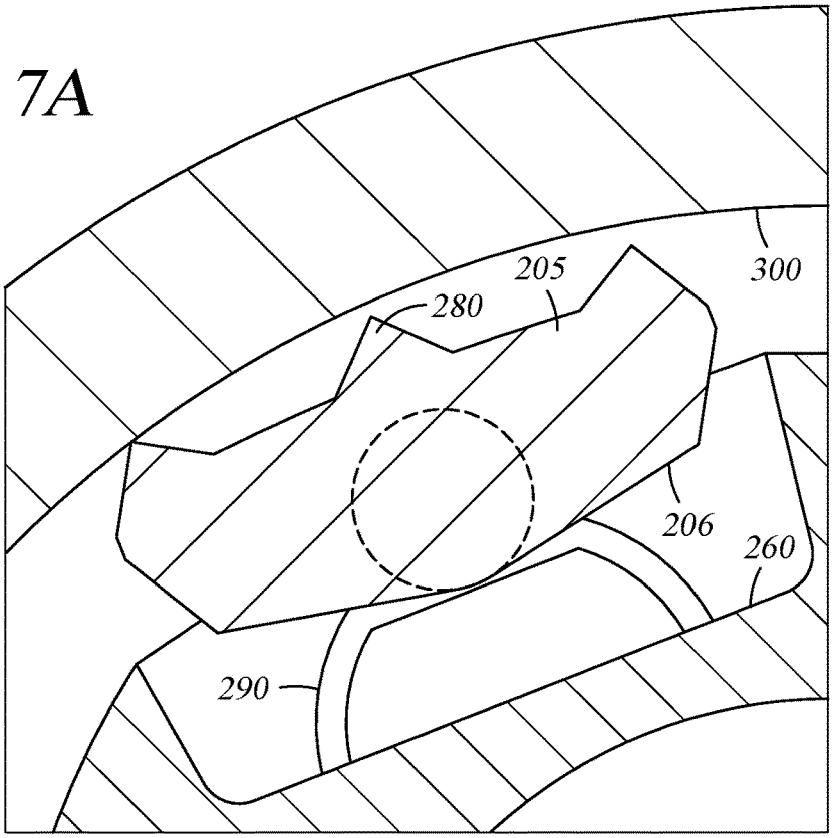
FIGS. 7A and 7B illustrate a slip before and after setting against a tubular wall, the wall having a relatively small ID.
Figure 7B:
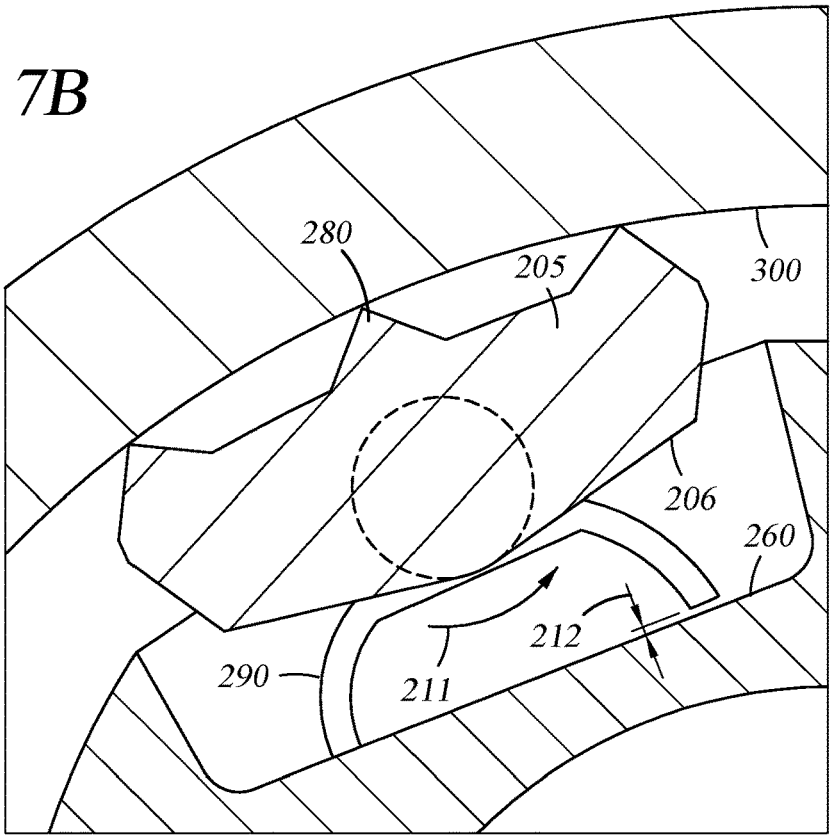

FIGS. 7A and 7B illustrate a slip 205 before and after setting against a tubular wall 300 having a relatively small ID. In FIG. 7A the slip is in its pre-set, rotationally centered position. However, due to the relatively small ID of the surrounding tubular 300, as the slip 205 is set and its wickers 280 extend to contact the ID of the tubular therearound, a wicker 280 at one side of the slip touches the tubular wall first, causing the slip 210 to rotate in a counter clockwise direction 211 about its longitudinal axis until all of the wickers are in contact with the wall 300 as shown in FIG. 7B. Visible also in FIG. 7B, one leg 292 of the centering member 290 has been lifted off of the pocket floor leaving a gap 212.

Figure 8:
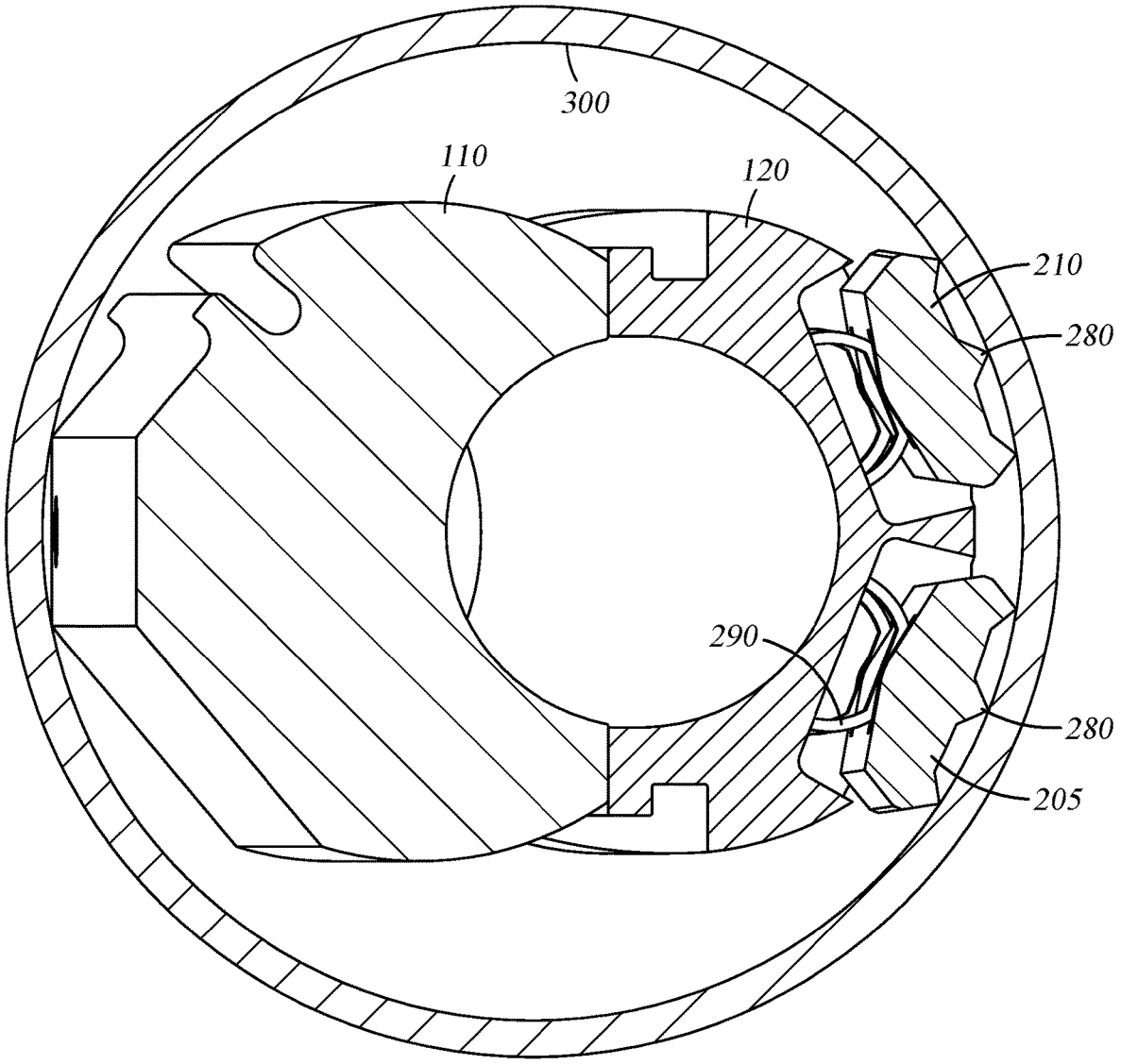
FIG. 8 is a section view taken from above, showing both slips set against a tubular having a relatively large ID.
Figure 9:
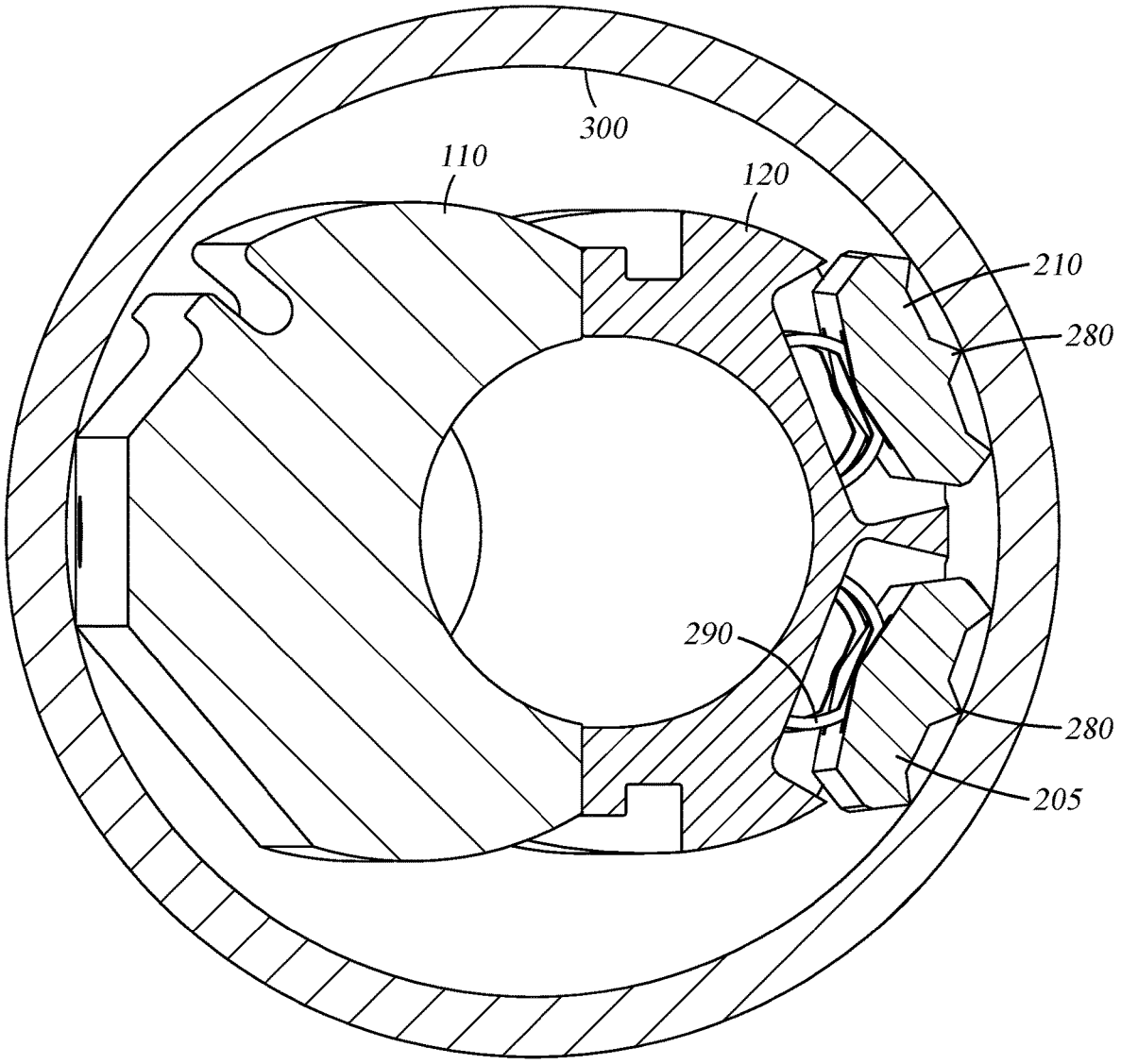
FIG. 9 is a section view taken from above, showing both slips set against a tubular having a relatively small ID.

FIG. 8 is a section view taken from above, showing both slips 205, 210 set against a tubular 300 having a relatively large ID and FIG. 9 is a section view taken from above, showing both slips set against a tubular 300 having a relatively small ID. As shown in each Figure, the wickers 280 of each slip are in contact with the tubular wall and opposite the slips 205, 210, the upper portion 110 of the anchor is set against an opposite wall of the tubular 300.

In use, the assembly 100 operates in the following fashion: A work string including the anchor assembly and typically, other downhole tools, like a whipstock is run into a wellbore lined with a tubular string, like casing 300. At a predetermined location and rotational position, the anchor is set by causing a lower portion 120 to move relative to an upper portion 110, thereby increasing an outer diameter of the assembly and bringing at least one slip 205 into contact with a wall of the surrounding tubular. Thereafter, optionally, the assembly is further set due to downward force on upper portion 110 from the surface of the well to increase a wedging effect between the assembly 100 and the wellbore.

Depending on the geometry, surface characteristics, and inner diameter of the tubular around the assembly, the at least one slip 205 may rotate about a longitudinal axis as it comes into contact with the tubular wall, thereby increasing the surface contact between the wickers 280 of the slip and the tubular wall.

While the invention is used with a whipstock for sidetracking a wellbore, it could be used with any downhole apparatus wherein there is a need to anchor the apparatus at least temporarily in the wellbore. The assembly is shown with two slips 205, 210, each of which has a plurality of wickers 280 arranged along the length and width of the face of the slip. It will be understood however, that the assembly 100 could include any number of slips, at least some of which are provided with means for rotating along at least one axis relative to at least one portion of the assembly. Also, the assembly 100, in the embodiment described is used in a cased or lined wellbore. However, the invention is equally usable in an open wellbore where variations in borehole walls can be overcome with the self-adjusting slips described herein.

Additionally, while the embodiment illustrated and discussed includes a two-part assembly wherein the slips are disposed on one side of the anchor, it will be understood that the invention could be used with other types of anchor bodies. For example, in one alternative embodiment, the slips are disposed in carriers around the perimeter of a conically shaped member. As the cone moves relative to the carriers, the slips are urged outwards, thereby enlarging the outer diameter of the assembly and setting the slips, with their rotational feature, against the wall of the wellbore in a radial fashion.

While the foregoing is directed to embodiments of the present invention, other and further embodiments of the invention may be devised without departing from the basic scope thereof, and the scope thereof is determined by the claims that follow.

The invention claimed is:

1. An anchor for use downhole, comprising:
- a run-in position in which the anchor has a smaller outer diameter;
- a set position wherein the anchor has a larger outer diameter; and
- a slip assembly having at least one slip, the slip having a longitudinal axis parallel to the longitudinal axis of the anchor and rotatable relative to the anchor along the longitudinal axis of the slip assembly and each slip includes a centering member for centering the slip in the anchor.

2. The anchor of claim 1, wherein the slip assembly is located on a first side of the assembly anchor and the anchor includes an upper portion and a lower portion.

3. The anchor of claim 2, wherein in the set position, the at least one slip contacts an inner wall of a surrounding tubular.

4. The anchor of claim 3, wherein in the set position, a second side of the assembly anchor opposite the first side contacts the inner wall of the tubular.

5. The anchor of claim 3, wherein the at least one slip has a plurality of wickers disposed on an outer surface thereof and wherein rotation of the slip about its longitudinal axis changes the point of contact between the wickers and the tubular wall.

6. The anchor of claim 5, wherein the anchor includes two slips disposed side by side on the first side of the lower portion.

7. The anchor of claim 2, wherein the slip assembly is located on the lower portion of the anchor.

8. The anchor of claim 7, wherein the set position is achieved by the lower portion moving axially relative to the upper portion.

9. The anchor of claim 8, wherein achievement of the set position is due to a biasing member urging the lower portion upwards relative to the upper portion.

10. The anchor of claim 7, wherein the anchor is further set by downward movement of the upper portion relative to the lower portion.

11. The anchor of claim 1, wherein each centering member comprises two resilient legs.

12. The anchor of claim 11, wherein each leg contacts the anchor when the slip is in a centered position.

13. The anchor of claim 1, wherein each slip is installed in a pocket of the anchor.

14. The anchor of claim 13, wherein each slip includes a bearing pivotally seated in a bearing housing of the pocket.

15. A method of setting an anchor in a wellbore, the method comprising:

providing an anchor having at least one slip disposed thereon, the slip constructed and arranged to rotate about a longitudinal axis of the slip;

running the anchor into the wellbore to a predetermined location;

centering the slip while running the anchor into the wellbore: and setting the anchor in the wellbore by causing an outer diameter of the anchor to increase, whereby the at least one slip rotates about the axis as the slip contacts a wall of the wellbore.

16. The method of claim 15, wherein the longitudinal axis of the slip is parallel to a longitudinal axis of the anchor.

17. The method of claim 16, wherein the outer diameter of the anchor is increased by causing one portion of the anchor to move axially relative to a second portion.

18. The method of claim 17, further including forming a window in casing installed in the wellbore, the window formed using a whipstock attached to the set anchor.

19. The method of claim 15, wherein the slip is installed in a pocket of the anchor, and the slip rotates relative to the pocket.

20. The anchor of claim 15, wherein the slip includes wickers disposed on a first side of the slip for contacting the wall and a centering member disposed on a second side of the slip.

21. An anchor for use downhole, comprising:

a run-in position in which the anchor has a smaller outer diameter, wherein the anchor includes an upper portion and a lower portion;

a set position wherein the anchor has a larger outer diameter; and a slip assembly located on the lower portion and includes at least one slip, the slip having a longitudinal axis parallel to the longitudinal axis of the anchor and rotatable relative to the anchor along the longitudinal axis of the slip assembly, wherein the set position is achieved by the lower portion moving axially relative to the upper portion.

22. The anchor of claim 21, wherein the set position is achieved by the lower portion moving axially relative to the upper portion.

23. The anchor of claim 22, wherein achievement of the set position is due to a biasing member urging the lower portion upwards relative to the upper portion.

* * * * *